US005755070A

United States Patent [19]

Hohmann

[11] Patent Number: 5,755,070

[45] Date of Patent: May 26, 1998

[54] MULTI VENEER ANCHOR STRUCTURAL ASSEMBLY AND DRYWALL CONSTRUCTION SYSTEM

[75] Inventor: Ronald P. Hohmann, Syosset, N.Y.

[73] Assignee: Hohmann Enterprises, Inc., Hauppauge, N.Y.

[21] Appl. No.: 409,877

[22] Filed: Mar. 24, 1995

Related U.S. Application Data

[62] Division of Ser. No. 149,708, Nov. 9, 1993, Pat. No. 5,440,854, which is a continuation of Ser. No. 31,014, Mar. 11, 1994, abandoned, which is a continuation of Ser. No. 793,501, Nov. 15, 1991, abandoned, which is a continuation of Ser. No. 399,074, Aug. 28, 1989, abandoned.

[51] Int. Cl.[6] ..... E04B 9/00

[52] U.S. Cl. ..... 52/489.1; 52/379; 52/508

[58] Field of Search ..... 52/508, 509, 477, 52/488, 489, 490, 660, 713, 714, 378, 379

[56] References Cited

U.S. PATENT DOCUMENTS

| | | | |
|---|---|---|---|
| 1,241,885 | 10/1917 | Roeder | 52/714 |
| 1,773,339 | 8/1930 | Beall . | |
| 2,281,951 | 5/1942 | Schroeder | 542/477 X |
| 2,369,100 | 2/1945 | Young . | |
| 2,553,363 | 5/1951 | Droeger . | |
| 3,370,391 | 2/1968 | Dupuis et al. . | |
| 3,412,515 | 11/1968 | Finon . | |
| 3,535,846 | 10/1970 | Storch . | |
| 4,021,990 | 5/1977 | Schwalberg . | |
| 4,145,859 | 3/1979 | Ollinger . | |
| 4,223,505 | 9/1980 | Krebel et al. . | |
| 4,373,314 | 2/1983 | Allan . | |
| 4,596,102 | 6/1986 | Catani et al. . | |
| 4,598,518 | 7/1986 | Hohmann . | |
| 4,827,684 | 5/1989 | Allan . | |
| 4,922,680 | 5/1990 | Kramer et al. . | |

*Primary Examiner*—Lanna Mai

*Attorney, Agent, or Firm*—Lackenbach Siegel Marzullo Aronson & Greenspan, P.C.

[57] ABSTRACT

A multi veneer anchor structural assembly for interconnection between the inner wythe and the outer wythe of an edifice. The assembly includes a pair of base members mounted in spanning relationship with at least vertical channels which form the frame of an edifice. A vertical plate is connected between the base members and has formed thereon a plurality of outwardly projecting vertical members each of which is engagable with a wall tie; with the wall ties being connected to an outer wythe. The assembly forms part of a drywall construction system which includes an insulating strip disposed between adjacent ones of the vertical plates, thereby providing a complete insulating layer for the edifice. In an alternate embodiment, the vertical plate is fabricated with a plurality of locally deformed areas which results in a high degree of stiffness of the veneer anchor structural assembly.

7 Claims, 8 Drawing Sheets

FIG. 9
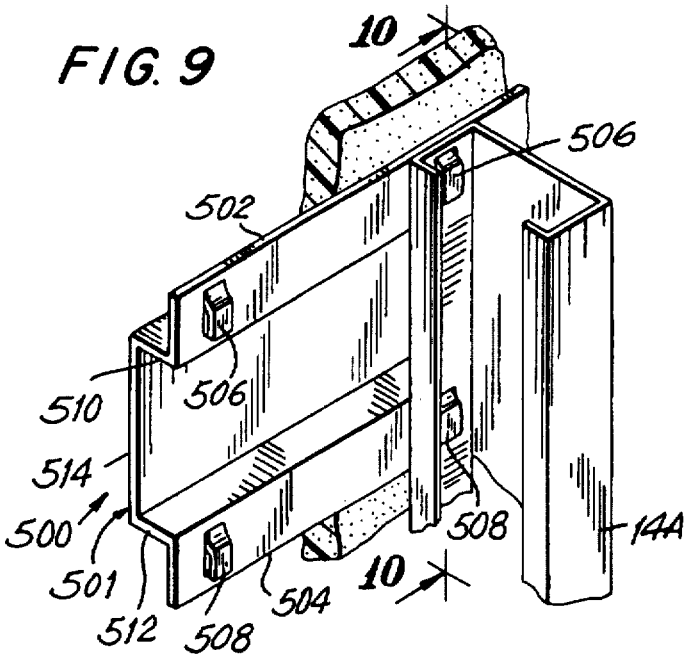
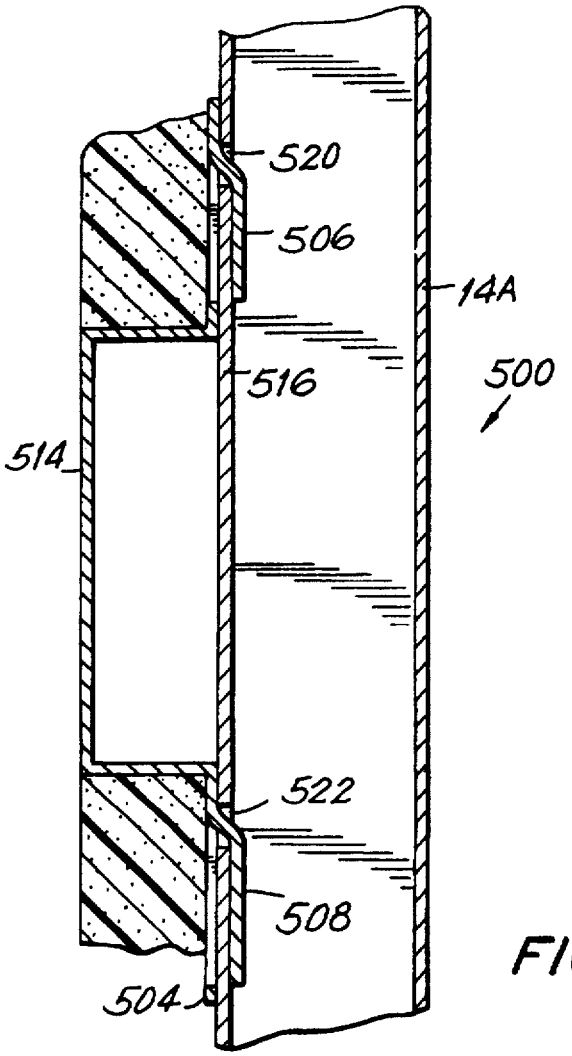
FIG. 10

FIG. 11
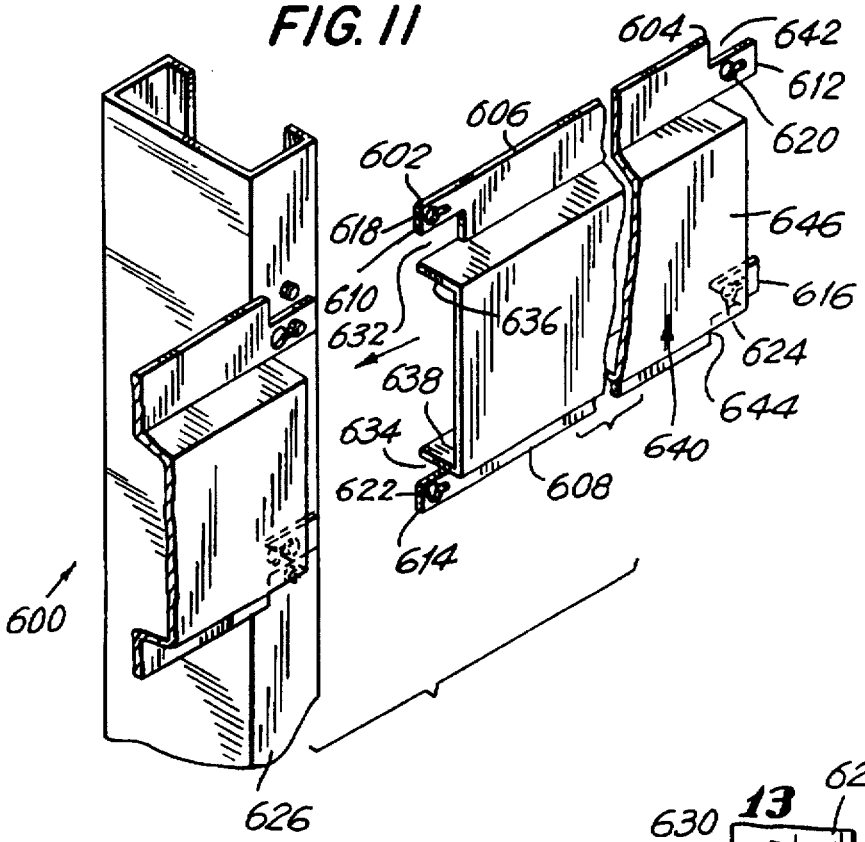
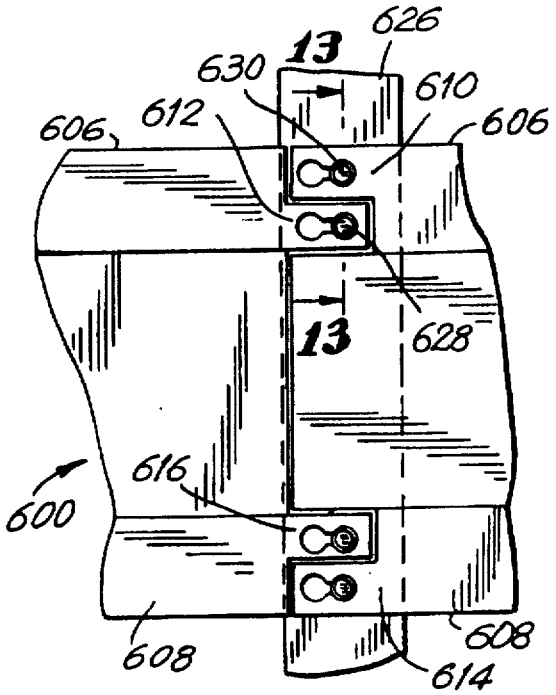
FIG. 12
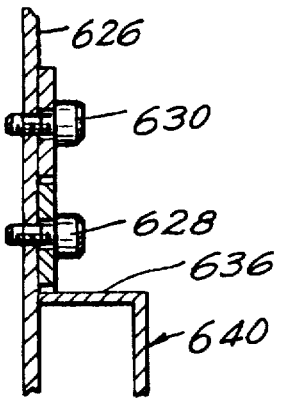
FIG. 13

MULTI VENEER ANCHOR STRUCTURAL ASSEMBLY AND DRYWALL CONSTRUCTION SYSTEM

RELATED PATENT APPLICATIONS

This application is a division of U.S. patent application, Ser. No. 08/149,708, filed Nov. 9, 1993, now U.S. Pat. No. 5,440,854, granted Aug. 15, 1995; which is a continuation of U.S. Ser. No. 08/031,014, filed Mar. 11, 1993 (now abandoned); which is a continuation of U.S. Ser. No. 07/793,501, filed Nov. 15, 1991 (now abandoned); which is a continuation of U.S. Ser. No. 07/399,074, filed Aug. 28, 1989 (now abandoned).

BACKGROUND OF THE INVENTION

The prior art related to veneer drywall construction systems includes several examples of veneer anchors which are used to interconnect inner and outer wythes. Examples of this prior art may be seen in U.S. Pat. Nos. 4,021,990 and 4,598,518.

U.S. Pat. No. 4,021,990 shows a drywall construction system in which the veneer anchor has a plate member which includes a relatively narrow vertically projecting bar disposed parallel to the plate member. The veneer anchor is used to secure a wall board layer to a vertical channel, or standard framing member, by inserting sheet metal screws into bores formed in the plate member and fastening the sheet metal screws through the wall board and the vertical channel.

U.S. Pat. No. 4,598,518 shows a veneer anchor which includes a pair of pronged members which are forced through a wall board layer until the pronged members abuttingly engage the front flange of a vertical channel member. Thereafter, sheet metal screws are inserted into bores formed in the veneer anchor and fastened through the wall board layer and the front flange of the channel member.

In each of the above examples, the veneer anchor is attached to a single vertical channel and to a single wall tie member.

After the above described veneer wall anchors are attached to the vertical channels, the wall tie members, which are formed of wire and have a generally truncated triangular configuration, are connected to the veneer wall anchors by attaching the apex portions of the wall tie members to the projecting bar portions of the veneer wall anchors. The base portions of the wall tie members are then attached to an outer wythe by inserting the base portions of the wall tie members into the mortar joints of the outer wythe.

The disadvantages of the prior art include the possibility of limited stability of the wall anchors caused by possible compression, settling or disintegrating of the insulating or wall board layer and the problems caused by the piercing of the wall board layer by the sheet metal screws shown in U.S. Pat. No. 4,021,990 or the combination of sheet metal screws and the pronged members in U.S. Pat. No. 4,598,518.

SUMMARY OF THE INVENTION

It is the primary object of the present invention to provide a new and novel multi veneer anchor structural assembly for use in drywall systems.

It is another object of the present invention to provide a new and novel multi veneer anchor structural assembly for securement of a wall board or insulation layer with respect to a plurality of vertical channels or framing members of an edifice employing a drywall construction system.

It is a further object of the present invention to provide a new and novel multi veneer anchor structural assembly and drywall construction system which permits the rapid placement and securement of a wall board or insulating layer with respect to channels or framing members.

It is yet another object of the present invention to provide a multi veneer wall anchor structural assembly which can be easily fabricated in large quantities and rapidly installed resulting in a low unit cost.

BRIEF DESCRIPTION OF THE DRAWINGS

The foregoing and other objects, features and advantages of the present invention will become more apparent from the detailed description hereinafter considered in conjunction with the drawings wherein:

FIG. 9 is a partial perspective view of still another alternative embodiment of the invention;

FIG. 10 is a cross-sectional view taken along the line 10—10 of FIG. 9;

FIG. 11 is a partial perspective view of another alternative embodiment of the invention;

FIG. 12 is a fragmentary front elevation view of the embodiment of the invention depicted in FIG. 11;

FIG. 13 is a cross-sectional view taken along the line 13—13 of FIG. 12;

DETAILED DESCRIPTION OF THE PREFERRED EMBODIMENTS

Figures 1, 5:
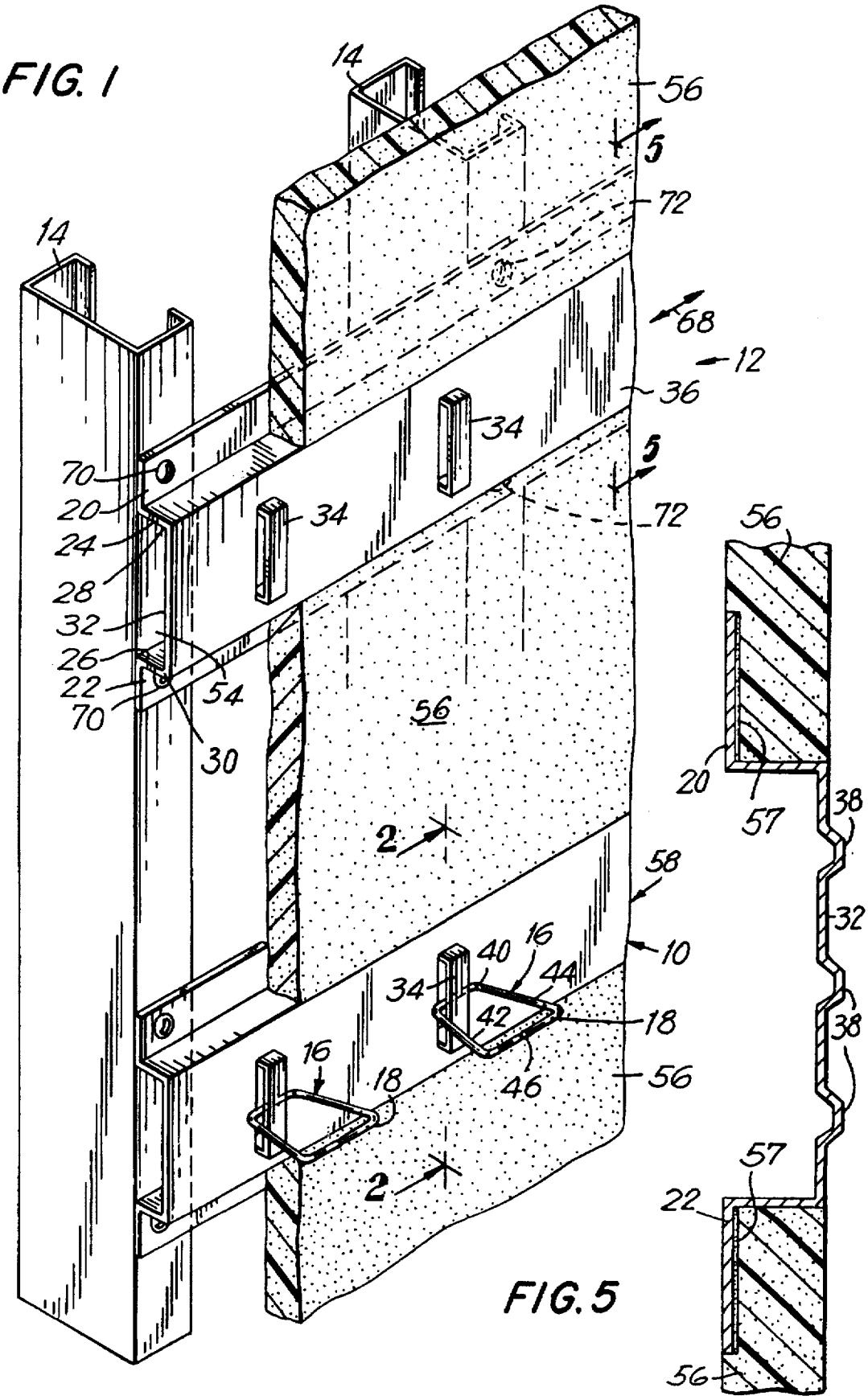
FIG. 1 is a partial perspective view of a drywall construction system fabricated in accordance with the principles of the present invention employing the new and novel multi veneer anchor structural assembly thereof.
FIG. 5 is a sectional view taken along the line 5—5 of FIG. 1 showing another alternative embodiment of the invention.

Referring to the drawings and more particularly to FIG. 1 thereof; there is depicted the new and novel drywall construction system denoted generally by the reference numeral 10 and fabricated in accordance with the principles of the present invention. The drywall construction system 10 employs the new and novel multi veneer anchor structural assembly generally denoted by the reference numeral 12. As is best seen in FIG. 1, the drywall construction system comprises a plurality of vertical channels 14, an insulating layer or wall board member 56, the multi veneer anchor structural assembly 12 and a plurality of wall ties 16. The vertical channels 14 form the framing members and inner wythe of an edifice.

The outer wythe, which is attached to the base portions 18 of the wall ties 16, is conventional in nature and has therefore not been shown. The outer wythe need also not be described in detail other than to indicate that it may be constructed of bricks, cinderblocks, stone or other suitably similar masonry materials which have regular or irregular configurations and wherein the base portions 18 of the wall ties 16 are inserted into the masonry joints during the construction of the outer wythe.

The multi veneer anchor structural assembly 12 includes a pair of base portions or members 20,22 which are disposed in alignment along a common plane. A pair of substantially horizontal projecting portions or flange members 24,26 are connected to the base portions 20,22 with the outer ends 28,30 of the projecting portions being connected to a vertical plate portion or planar member 32. The vertical plate portion 32 includes a plurality of elongated and forwardly projecting vertical members 34 which are disposed in spaced apart and generally parallel relationship to the surface 36 of the vertical planar member 32.

The base portions 20,22 each have a plurality of bores 70,72 which are spaced in accordance with the spacing of standard framing members 14. The wall tie members 16 illustrated herein are formed of wire and have the general configuration of a trapezoid with generally parallel larger and smaller base portions 18 and 40, respectively, which are connected by side portions 42,44. The larger base portion 18 includes an opening 46 which facilitates attachment of the wall ties 16 to the vertical projecting bar members 34 and thus to the multi veneer anchor structural assembly 12. The length of the smaller base 40 approximates the width of the vertical members 34, thereby contributing to the lateral stability of the drywall construction system 10, according to the present invention. However, it is herein to be noted that other types of wall ties may also be suitably employed herein.

The vertical members 34 may be formed by a punching operation during the fabrication of the assembly 12. In an alternative embodiment of the invention, illustrated in FIG. 5, the vertical planar member 32 also includes a plurality of dimpled or locally deformed areas 38 which increase the stiffness of the vertical planar member 32. The configuration of the dimpled areas 38 is shown, by way of example, in FIG. 5 and it is understood that a broad range of dimple configurations may be utilized to achieve the desired stiffness of the vertical planar member 32.

Figure 2:
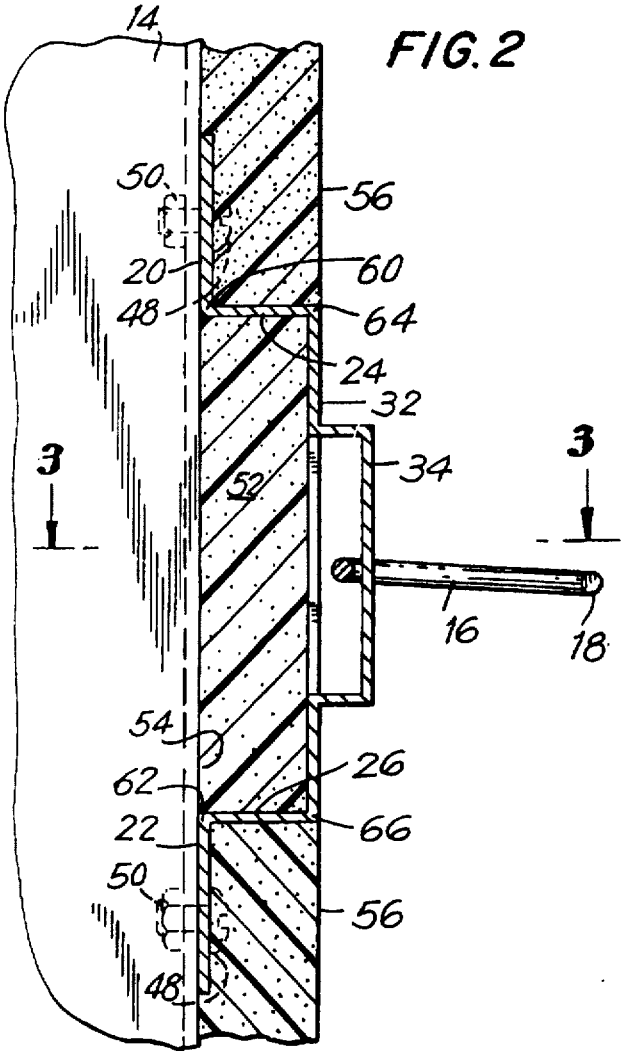
FIG. 2 is a sectional view taken along the line 2—2 of FIG. 1.
Figure 3:
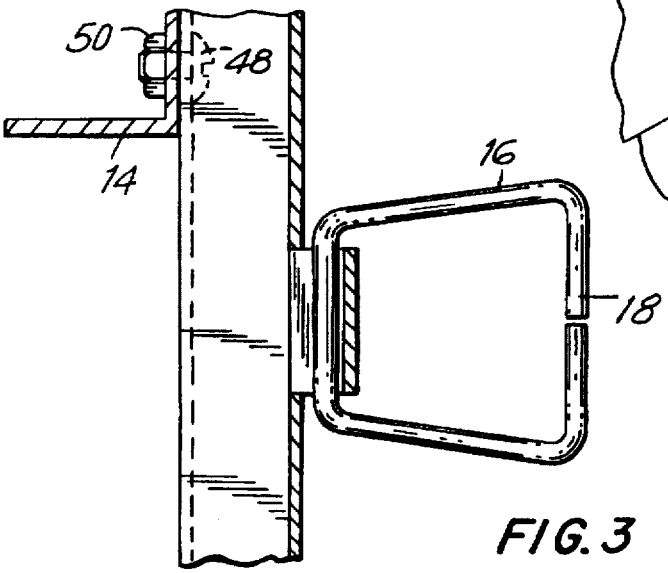
FIG. 3 is a sectional view taken on the line 3—3 of FIG. 2.

In use, the multi veneer anchor structural assembly 12 is attached to the vertical channel 14 by means of the screws 48 and nuts 50, as shown in FIGS. 2 and 3. Alternatively, self tapping screws or other fastening means may be used to attach the multiple veneer anchor structural assembly 12 to the vertical channels 14.

A strip of insulating material 52, which fills the space 54, defined by the projecting portions 24,26 and the vertical channels 14 may be inserted into the space 54. The addition of this strip of insulating material 52, in conjunction with the insulating layer 56, provides a complete layer of insulation between the inner and outer wythes. The insulating layer 56 is placed between adjacent ones of the multi veneer anchor structural assemblies 12. As illustrated in FIG. 1, the layer is disposed between an upper assembly and the identical multi veneer structural assembly 58, located below the multi veneer anchor assembly 12. The width of the flange members 24,26 approximate the thickness of the insulating layer 56 thereby ensuring that the insulating layer 56 is securely held between the adjacently disposed multi veneer anchor structural assemblies 12,58. A plurality of wall ties, each similar to the wall tie 16, is attached to the vertical members 34, as shown in FIGS. 1–4.

In the embodiment illustrated, the insulating layer 56 is proportioned so that it is force fitted between the multi veneer anchor structural assemblies 12,58. In an alternative embodiment, and as seen in FIG. 5, an adhesive layer 57 is used to attach the insulating layer 56 to the base members 20,22. It will be apparent to those skilled in the art that an adhesive layer may also be interposed between the inner surface of insulating layer 56 and the vertical channels 14 and may take the form of a double backed adhesive.

Figure 4:
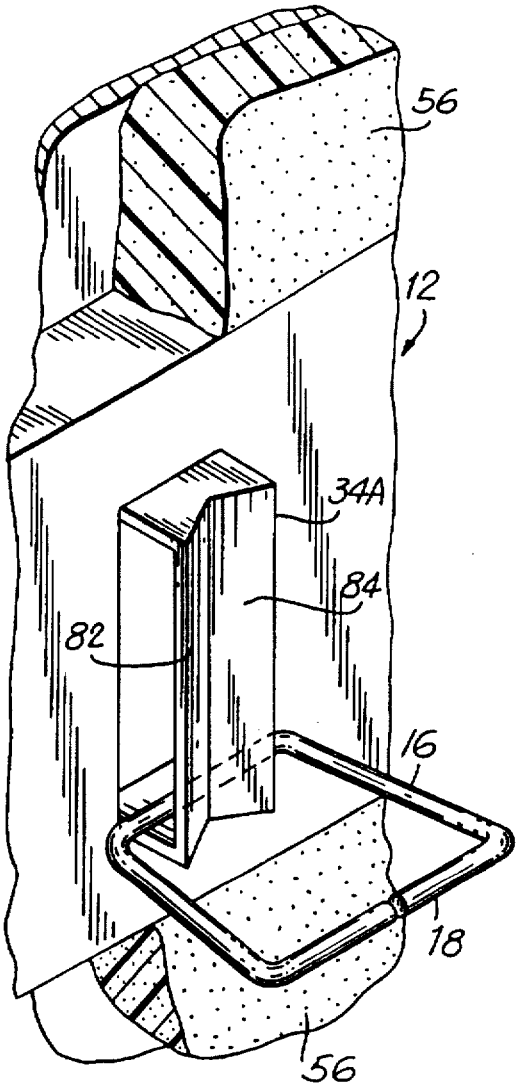
FIG. 4 is a partial perspective view of a portion of the drywall construction system of FIG. 1 drawn to an enlarged scale, showing an alternative embodiment of the invention.

FIG. 4 shows an alternative configuration of the vertical projecting bar member designated 34A. The configuration 34A includes a pair of angularly disposed plane portions 82,84.

In the preferred embodiment, the multi veneer anchor structural assembly 12 is fabricated of a single sheet of metal with the steps of fabrication including the relatively simple steps of forming the bends 60,62 between the base portions 20, 22 and the horizontally projecting portions 24,26, and the bends 64,66 between the flange members 24,26 and the vertical portion 32.

The high degree of stiffness of the multi veneer anchor structural assembly 12 in the lateral direction, indicated by the arrow 68 in FIG. 1 and the attachment of the multi veneer anchor structural assembly 12 to the vertical channels 14 provides a degree of rigidity to the drywall construction 10 according to the present invention which exceeds previous drywall construction systems.

Figure 6:
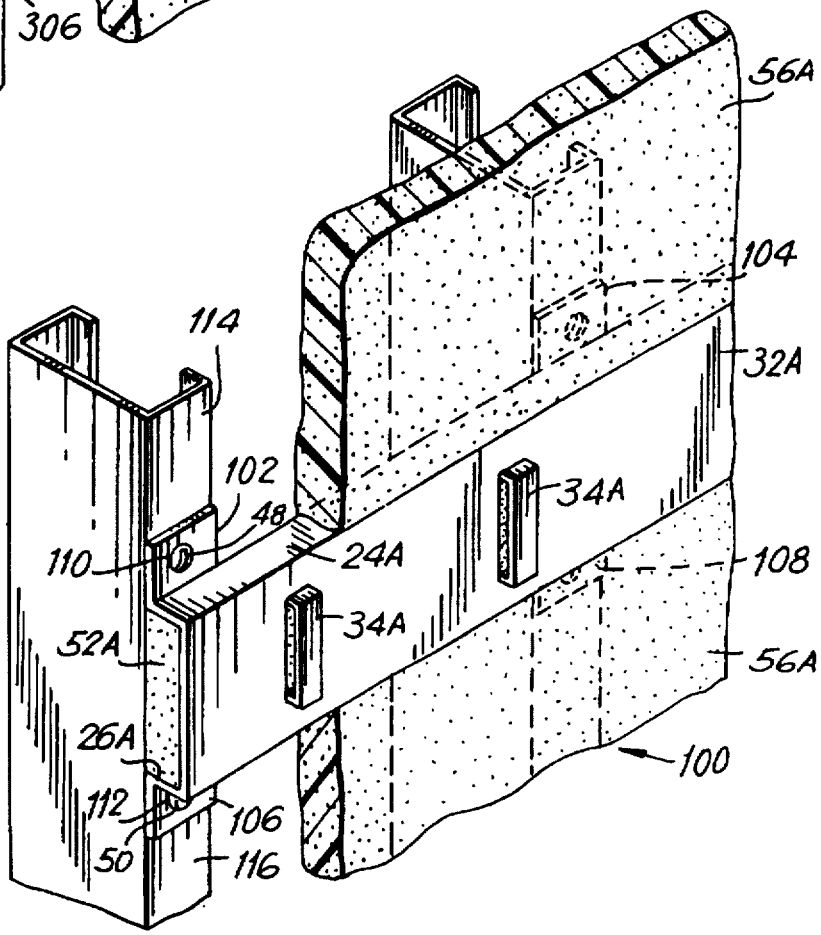
FIG. 6 is a partial perspective view of another alternative embodiment of the invention.

In an alternative embodiment of the invention denoted 100, shown in FIG. 6, the members 20,22 of FIGS. 1–5 are replaced by a plurality of spaced apart mounting tabs 102,104,106,108 which are connected to the flange members 24A,26A. The mounting tabs 102,104,106,108 are spaced in accordance with the spacing of standard framing members 14. Each of the mounting tabs includes a bore, typically designated by the reference numerals 110,112 for attachment of the mounting tabs 102,104,106,108 to the framing members 14 using conventional connection means such as screws 48 and nuts 50, as shown in FIG. 2.

The vertical plate 32A includes a plurality of vertical bar members 34A which are similar to the vertical bar members 34 which have been previously described in connection with FIGS. 1–5.

An insulating strip 52A is inserted behind the vertical plate 32A in a manner similar to the insulating strip 52 shown in FIG. 2. An insulating layer 56A is utilized in a manner similar to the insulating layer 56. In the embodiment of FIG. 6, the insulating layer 56A may be attached to the framing members 14 through the use of an adhesive layer which is typically disposed on members 14 in the location designated by the reference numerals 114,116 in FIG. 6. The adhesive layer may be in the nature of a double sided adhesive film.

Figure 6A:
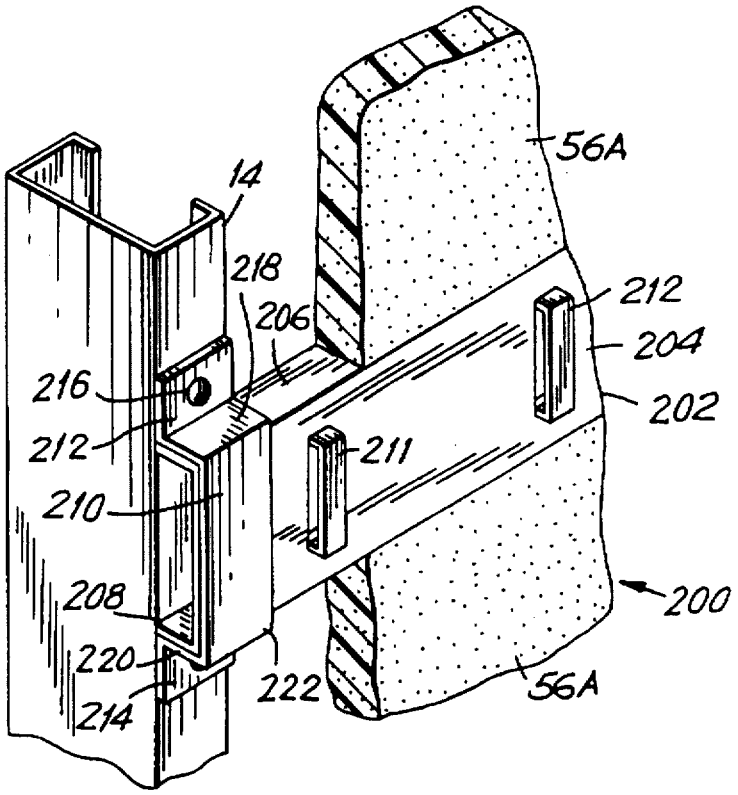
FIG. 6A is a partial perspective view of yet another alternative embodiment of the invention.

In another alternative embodiment of the invention shown in FIG. 6A and designated by the reference numeral 200, the mounting tabs 102,104,106,108 shown in FIG. 6 are removed and the channel member 202 which comprises a plate portion 204 and a pair of flange members 206,208, which are similar to the plate portion 32 and the flange members 24,26 of FIG. 1. are secured to the vertical channels 14 by a plurality of strap members 210. The plate portion 204 includes a plurality of vertical bar members 211 which are similar to the vertical bar members 34,34A of FIGS. 1 and 4.

The strap members 210 each have a pair of base portions 212,214 each of which include a bore 216 formed therein for attachment of the strap member 210 to the vertical channel 14. The members 210 include a pair of horizontal portions or flanges 218,220 and a vertical portion 222 which closely fit over the flange members 206 ,208 and the plate portion 204 of the channelmember 202.

Figure 7:
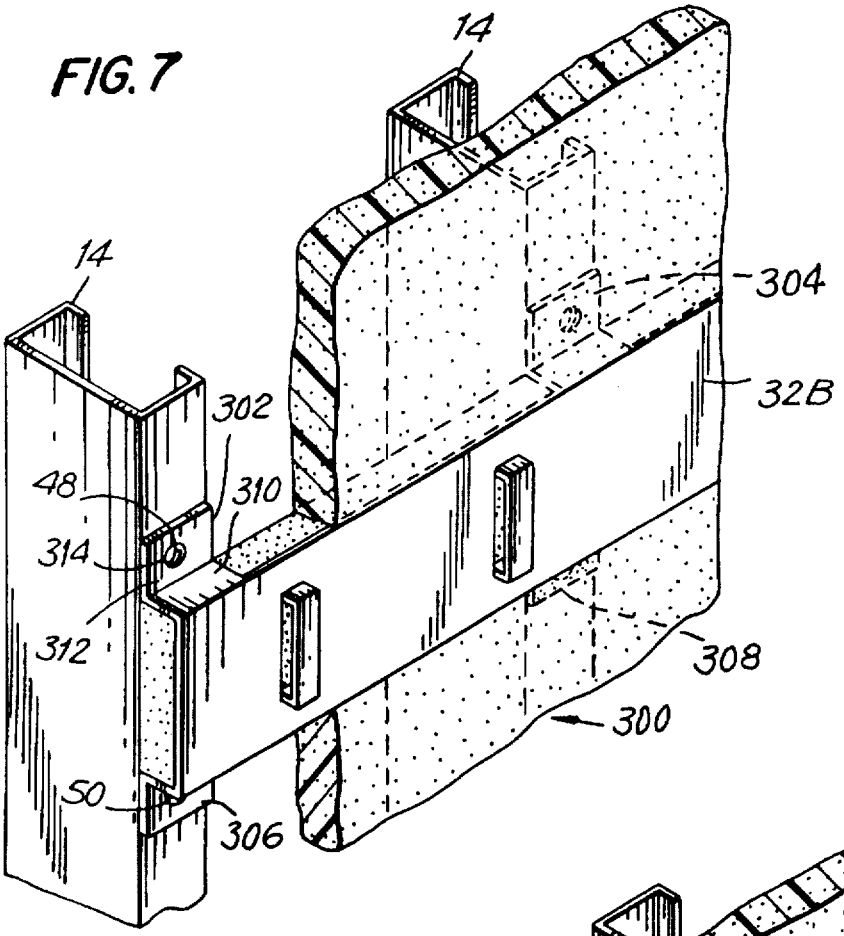
FIG. 7 is a partial perspective view of another alternative embodiment of the invention.

In an alternative embodiment of the invention shown in FIG. 7 and designated 300, both the base portions 20,22 and the flange members 24,26 of FIGS. 1–5 are replaced by a plurality of spaced apart mounting tabs 302,304,306,308 which are integrally formed with the vertical plate 32B. The mounting tabs 302,304,306,308 include a horizontal portion and a vertical portion typically designated by reference numerals 310 and 312, respectively, and a bore typically designated by the reference numeral 314. The mounting tabs 302,304,306,308 are spaced in accordance with the spacing of the standard framing members 14. The mounting tabs are attached to the framing members 14 using conventional screws 48 and nuts 50, of the type shown in FIG. 2.

Figure 8:
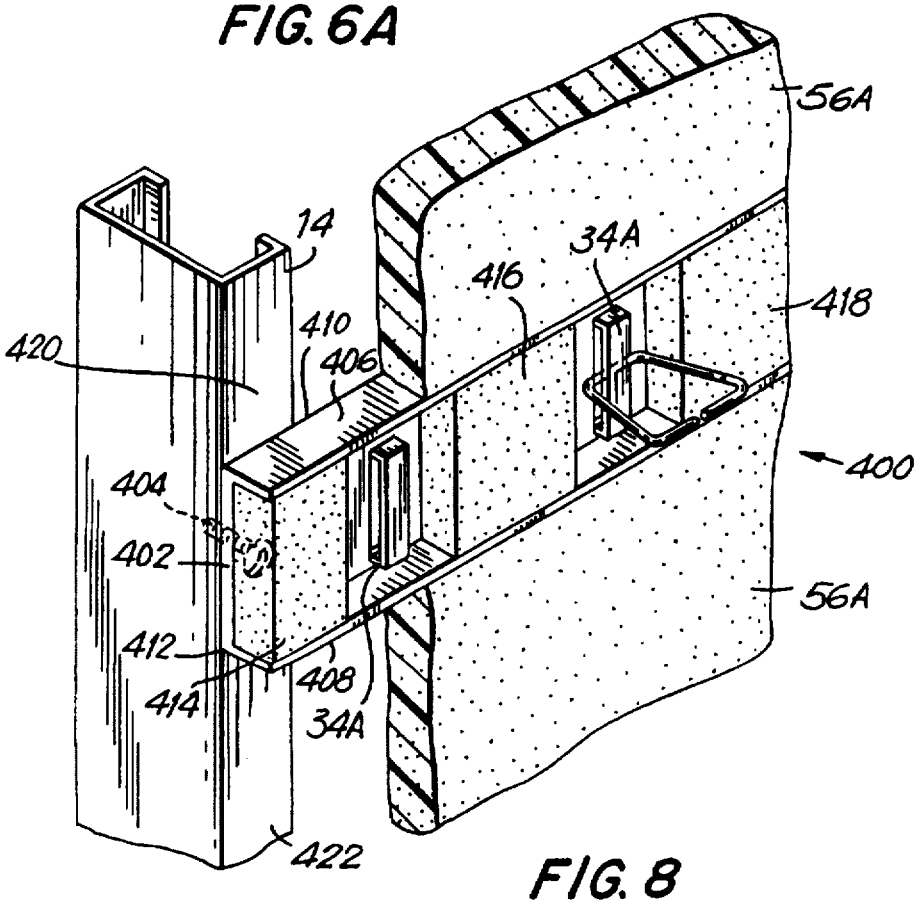
FIG. 8 is a partial perspective view of yet another alternative embodiment of the invention.

In another alternative embodiment of the invention shown in FIG. 8, denoted by the reference numeral 400, the plate portion 402, which is similar to the plate portion 32 of FIG. 1, is fastened directly to the vertical channel 14 using a plurality of screws such as illustrated by the reference numeral 404. The plate portion 402 includes a plurality of vertical bar members 34A of the type illustrated in FIG. 1. A plurality of wall tie members similar to the wall tie member 16 are mounted, one each, on the vertical bar members 34A.

A pair of flange members 406,408 are joined to upper and lower edges 410,412 of the plate portion 402 and provide a high degree of rigidity for the plate portion 402.

Individual blocks of insulating material 414,416,418 are disposed in an abutting relationship with the plate portion 402 and are disposed within the confines of flange members 406,408 between the horizontally adjacent ones of the vertical bar members 34A. In a manner similar to that which has been described in connection with FIG. 6, insulating layers 56A are provided between vertically adjacent ones of the veneer anchor structural assembly 400. The insulating layer 56A, as previously discussed, may be attached to the framing members 14 by means of a double backed adhesive layer secured to the layer 56A and the areas designated by the reference numerals 420, 422 on the channels 14.

In another alternative embodiment of the invention, the system designated by the reference numeral 500 is shown in FIGS. 9 and 10. The base members 502,504 include a plurality of integrally formed tabs 506,508 which cooperate with apertures 520,522 formed in the channel members 14A for securement of the base members 502,504 with respect to the channel members 14A. The tabs 506,508 are substantially parallel to and spaced apart from the base members 502,504 and may be formed by means of a punching and embossing operation during fabrication of the veneer anchor structural assembly 501. The base members 502,504 are formed integrally with horizontal portions 510,512 which are similar to the portions 24,26 of FIG. 1. The plate portion 514 is similar to the plate portion 32 of FIG. 1. The plate portion 514 includes vertical bar members (not shown) which are similar to the vertical bar member 34 of FIG. 1.

The tabs 506,508 are proportioned to abuttingly engage the surface 516 of the channel 14A thereby retaining and holding the base portions 502,504 against the channel 14A in a rigid and secure manner.

In another embodiment of the invention shown in FIGS. 11 through 13, the system 600 has the ends 602,604 of the base portions 606,608 keyed to form interlocking tabs 610,612,614,616. Each of the tabs include a keyhole aperture 618,620,622,624 for attachment to a vertically positioned channel or frame member 626. The vertical channel includes a plurality of cap screws 628,630 the heads of which fit through the larger portion of the keyhole apertures 618,620,622,624 and the body of which fits into the smaller portion of the keyhole apertures 618,620,622,624.

The base portions 606,608 are keyed by providing a cut-out or space 632,634 between the tab portions 610,614 and the flange portions 636,638 on the left end of the assembly 640. On the right end of the assembly 640, the spaces 642,644 are disposed outwardly relative to the tabs 612,616. The spaces 632,634 on the left end of the assembly 640 are proportioned to accept the tab portions 612,616 on the right ends of the assembly 640.

The veneer anchor assembly 640 includes plate portion 646 which has vertical bar members which are not shown in FIGS. 11–13, but which have been shown and described in detail in conjunction with FIG. 1.

In use, the base portions 606,608 are inserted onto cap screws 628,630 and then moved horizontally to move the smaller portion of the keyhole apertures 618,620,622,624 onto the body portion of the cap screws. Thereafter the cap screws 628,630 are tightened against the base portions 606,608.

Figure 14:
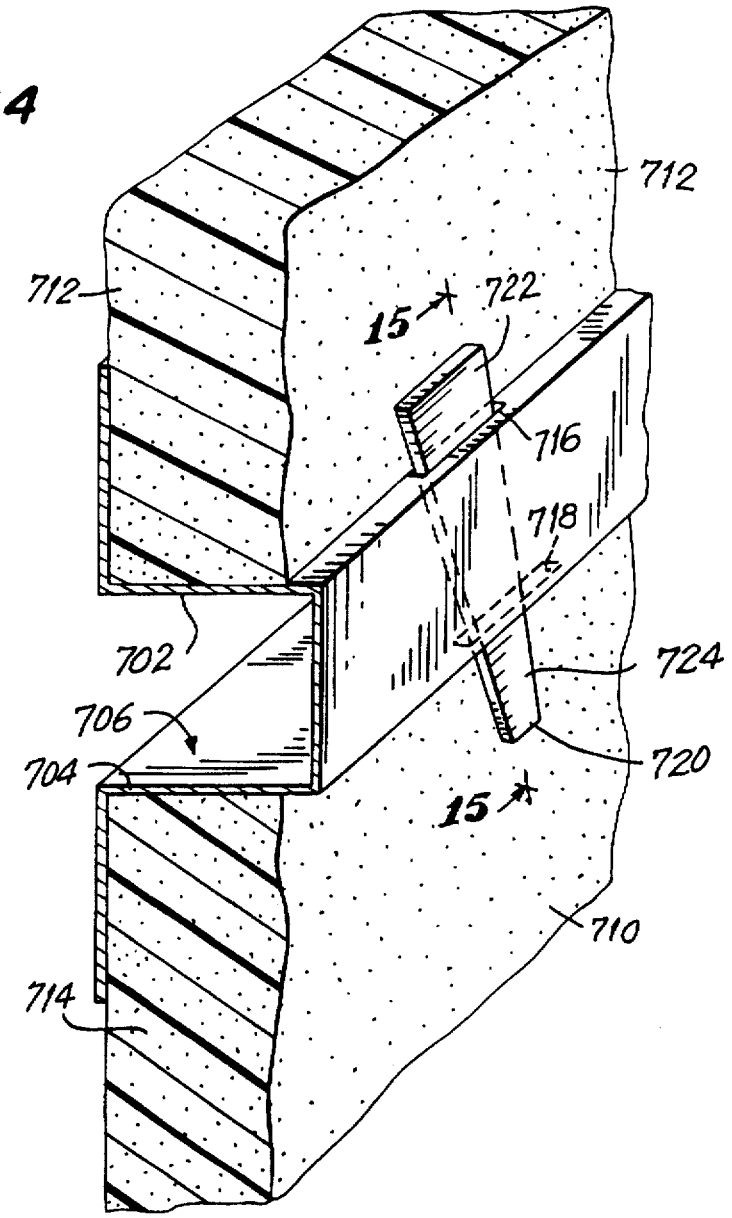
FIG. 14 is a partial perspective view of another alternative embodiment of the invention.
Figure 15:
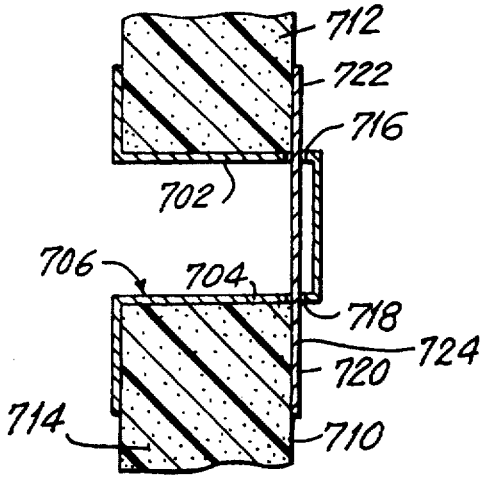
FIG. 15 is a cross-sectional view taken along the line 15—15 of FIG. 14.

Another alternative embodiment of the invention, designated 700, is shown in FIGS. 14 and 15. The horizontal portions 702,704 of the veneer anchor assembly 706 extend past the surfaces 708,710 of the insulation layers 712,714 and the horizontal portions 702,704 include apertures 716, 718 into which locking members 720 are insertable. The locking member 720 may be in the nature of a trapezoid or of another suitable shape which may be inserted into the apertures 716,718 leaving upper and lower projecting portions 722,724, respectively, which hold the insulation layers 712,714 in place.

The channel member 706 is attached to the support members of an edifice and also includes projecting bar members for securement of wall ties in a manner which is similar to those shown and described in previous embodiments of the invention.

Figure 16:
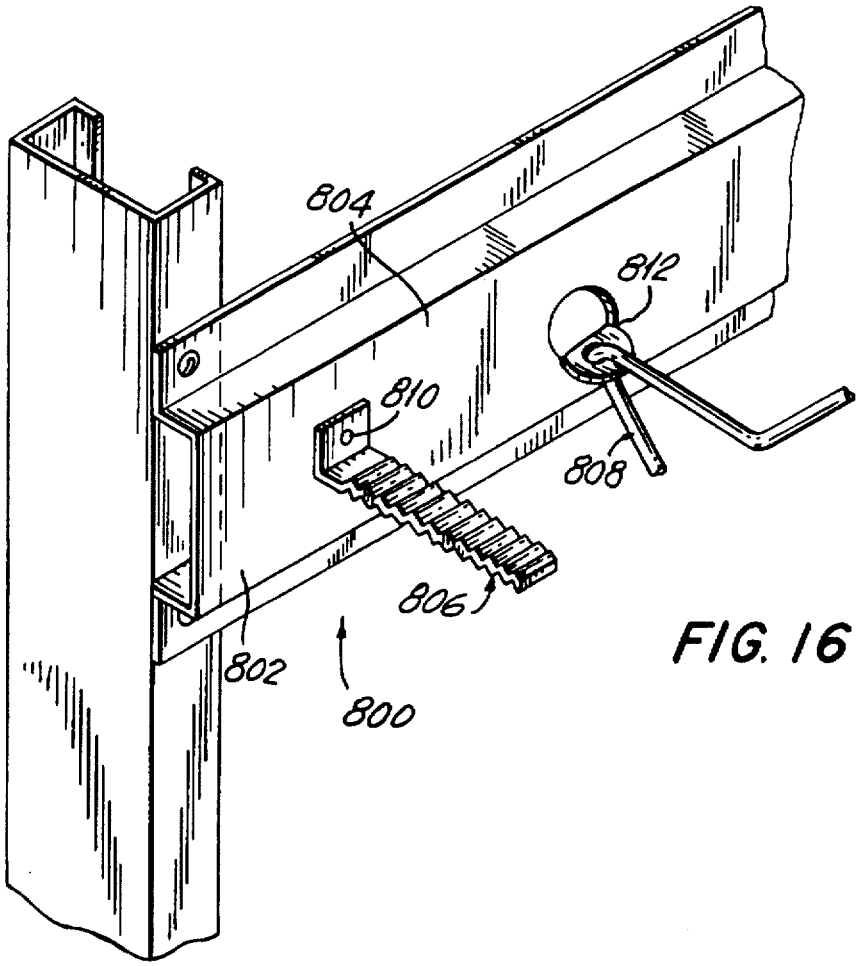
FIG. 16 is a partial perspective view of yet another embodiment of the invention.
Figure 17:
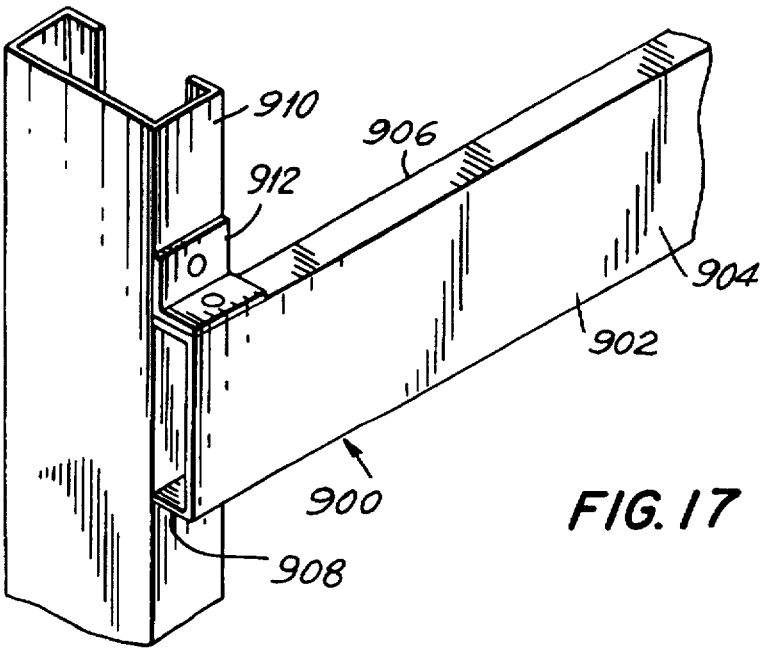
FIG. 17 is a partial perspective view of still another alternative embodiment of the invention.

In still another embodiment of the invention 800, shown in FIG. 16, the member 802 includes a plate portion 804 onto which a wall tie such as the wall ties 806,808 are attached by means of screw fasteners 810,812.

In yet another embodiment of the invention designated 900, the assembly 902 includes a plate portion 904 and a pair of flange portions 906,908 which abut the vertical channel 910. The member 902 is secured with respect to the channel 910 by means of clips, one of which is typically illustrated as the clip 912. The clip 912 may be secured to the flange 906 and the channel 910 by either screws or a welding operation.

It will be apparent from the foregoing discussion that the drywall construction systems 10,100,200,300,400, 500,600, 700,800,900 will retain its structural integrity irrespective of the ultimate decay, deterioration or destruction of the insulating layers 52,56 or 52A,56A. In this regard, the wall ties 16 are prevented from having any appreciable horizontal or lateral movement by virtue of the function of the vertical members 34, while the multi veneer anchor structural assembly 12 is prevented from horizontal movement by virtue of the direct and rigid connection of the base portions 20,22 and the vertical channels 14 or the other similar portions or members with respect to the other designated vertical channels.

The construction systems 10,100,200,300,400,500,600, 700,800,900 accordingly do not depend on the insulating layers 56,56A for rigidity in any respect, due to the inherent stiffness of the multi veneer anchor structural assemblies 12. The outer wythe is prevented from moving inwardly even if the insulating layers 56,56A are completely removed. This ultimate securement of the outer wythe to the channel members 14, forming the inner wythe, guarantees the structural integrity of the drywall construction systems by preventing premature deterioration of the outer wythe. This could occur if the outer wythe were capable of moving inwardly toward the inner wythe upon deterioration of the insulating layer or similarly disposed layer.

What I have provided is a new and novel multi veneer anchor structural assembly in conjunction with a drywall construction system which obviates problems which may occur or which are of concern in prior art systems and devices. In particular, the securement features of the wall ties in conjunction with the multi veneer anchor structural assembly guarantees the structural integrity of the outer wythe irrespective of the problems of displacement or deterioration which may occur to the insulation layers.

While I have shown and described the preferred embodiments of the invention, it will be readily apparent to those skilled in the art that there are changes, modifications and improvements which may be made therein without departing from the spirit and scope thereof as previoulsy defined and envisioned and as may hereinafter be claimed.

What is claimed:

1. A drywall construction system having a structural assembly for securement between an inner wythe having a plurality of vertically disposed spaced apart support members, and an outer wythe of an edifice for residential/office/industrial use, said structural assembly comprising, in combination, at least two longitudinally extending channel assemblies each formed substantially as a U with a trough between opposing longitudinal extending flanges, and extending between at least two of said vertically disposed support members, of said inner wythe, for forming a portion of a wall surface, and each channel assembly comprising an elongated planar member having longitudinal side edges, and having said longitudinally extending flanges attached at a longitudinal side edge to each said longitudinal side edge of said planar member; said elongated planar member of each said channel assembly member resting against and being secured to said vertically disposed support members, a plurality of separate, individual spaced apart anchor members fixedly secured to each said planar member and extending longitudinally along said planar member; means for securing each channel assembly to said vertically disposed support members of said inner wythe; outer wall means of said structural assembly engaged to a plurality of said anchor members for individually securing said anchor members to said outer wythe by means of a plurality of wall ties for forming said portion of said wall surface; and sheet insulation supported at least in part by said longitudinally extending flanges, and being substantially planar with each planar member of said adjacently disposed channel assemblies.

2. The structural assembly according to claim 1, wherein said planar member, and said longitudinally extending flanges are integrally formed as a single unitary element.

3. The structural assembly according to claim 1, wherein said anchor members are disposed in substantially parallel and planar relationship with respect to one another, and in substantially parallel planar relationship with respect to said planar member.

4. The structural assembly according to claim 1, wherein said anchor members are formed integrally with and project forwardly from said planar member.

5. The structural assembly according to claim 4, wherein said anchor members project into said trough of said U-shaped channel assembly.

6. The structural assembly according to claim 1, wherein said sheet insulation is also supported by and disposed between the longitudinally extending flanges forming the U-shape of each said channel assembly, and between said anchor members.

7. The structural assembly according to claim 1, wherein said planar member, said flange members, and said anchors are formed integrally with one another.

* * * * *